US006303279B1

(12) United States Patent
Twist

(10) Patent No.: US 6,303,279 B1
(45) **Date of Patent: *Oct. 16, 2001**

(54) PHOTOGRAPHIC DEVELOPER/AMPLIFIER COMPOSITIONS

(75) Inventor: Peter Jeffery Twist, Gt. Missenden (GB)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 08/317,977

(22) Filed: Oct. 4, 1994

(30) Foreign Application Priority Data

Oct. 20, 1993 (GB) ..... 9321648

(51) Int. Cl.[7] ..... G03C 7/413

(52) U.S. Cl. ..... 430/461; 430/373; 430/414; 430/943

(58) Field of Search ..... 430/373, 414, 430/461, 943

(56) References Cited

U.S. PATENT DOCUMENTS

| | | | | |
|---|---|---|---|---|
| 3,747,525 | | 7/1973 | Maffet et al. | 101/450 |
| 4,219,615 | * | 8/1980 | Sakai | 430/373 |
| 4,414,305 | * | 11/1983 | Nakamura et al. | 430/373 |
| 4,458,009 | | 7/1984 | Weyde et al. | 430/350 |
| 4,469,780 | * | 9/1984 | Hirai et al. | 430/373 |
| 4,880,725 | * | 11/1989 | Hirai et al. | 430/373 |
| 4,954,425 | * | 9/1990 | Iwano | 430/373 |
| 5,200,301 | * | 4/1993 | Wingender et al. | 430/373 |
| 5,215,875 | * | 6/1993 | Matejic et al. | 430/505 |
| 5,246,822 | * | 9/1993 | Evans et al. | 430/429 |
| 5,358,830 | * | 10/1994 | Twist | 430/399 |
| 5,387,499 | * | 2/1995 | Earle et al. | 430/373 |

FOREIGN PATENT DOCUMENTS

| | | | |
|---|---|---|---|
| 2106660 | * | 4/1983 | (GB) . |
| 83/46008 | | 10/1983 | (JP) . |
| 1075227 | | 2/1984 | (RU) . |

* cited by examiner

*Primary Examiner*—Hoa Van Le
(74) *Attorney, Agent, or Firm*—J. Lanny Tucker

(57) ABSTRACT

An aqueous redox amplifier composition comprising a color developing agent, hydrogen peroxide or a compound which provides hydrogen peroxide and hydroxylamine or a salt thereof wherein the concentration ranges are:

Figure 1:
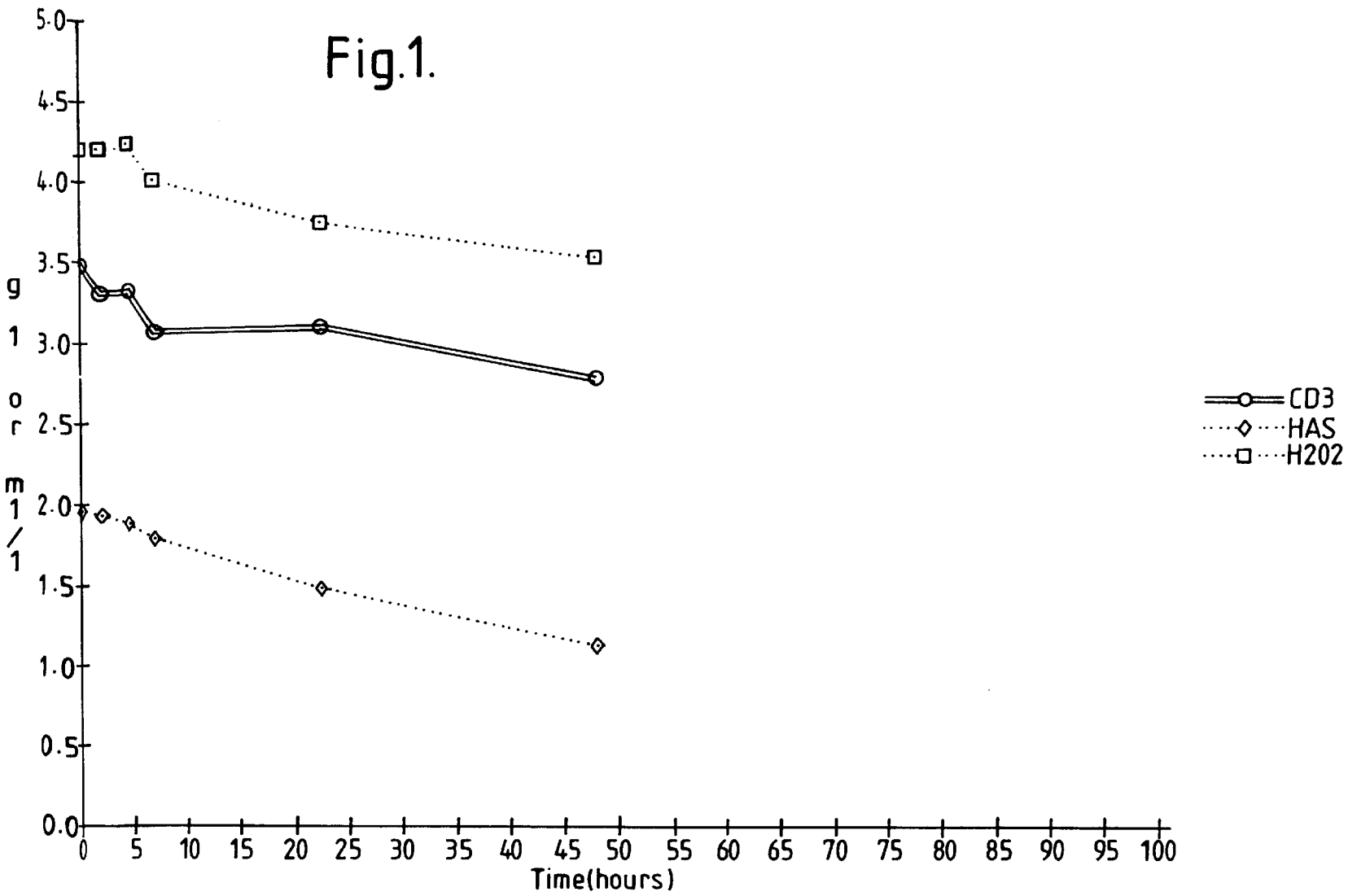

hydrogen peroxide from 0.5 to 10 ml/l (as 30% w/w solution), hydroxylamine or a salt thereof from 0.25 to 5.5 g/l (as hydroxylamine sulphate), and wherein the pH is in the range from 10.5 to 12.

15 Claims, 1 Drawing Sheet

PHOTOGRAPHIC DEVELOPER/AMPLIFIER COMPOSITIONS

FIELD OF THE INVENTION

This invention relates to photographic developer/amplifier solutions useful in redox amplification processes.

BACKGROUND OF THE INVENTION

Redox amplification processes have been described, for example in British Specification Nos. 1,268,126, 1,399,481, 1,403,418 and 1,560,572. In such processes colour materials are developed to produce a silver image (which may contain only small amounts of silver) and then treated with a redox amplifying solution (or a combined developer-amplifier) to form a dye image.

The developer-amplifier solution contains a colour developing agent and an oxidising agent which will oxidise the colour developing agent in the presence of the silver image which acts as a catalyst.

Oxidised colour developer reacts with a colour coupler to form the image dye. The amount of dye formed depends on the time of treatment or the availability of colour coupler and is less dependent on the amount of silver in the image as is the case in conventional colour development processes.

Examples of suitable oxidising agents include peroxy compounds including hydrogen peroxide and compounds which provide hydrogen peroxide, eg addition compounds of hydrogen peroxide; cobalt (III) complexes including cobalt hexammine complexes; and periodates. Mixtures of such compounds can also be used.

A serious problem with developer/amplifier solutions is their stability because they contain both an oxidising agent (eg the peroxide) and a reducing agent (the colour developing agent) which react together spontaneously thus leading to loss of activity in a matter of an hour or two.

In comparison, conventional photographic colour developer solutions suffer loss of activity by aerial oxidation of the colour developing agent. A typical commercial colour developer solution, however, will be stable for a week or two. Both diethylhydroxylamine and hydroxylamine sulphate have been proposed as anti-oxidants for colour developer solutions.

Colour developer solutions for silver chloride colour papers do not contain hydroxylamine sulphate because it can act as a black and white developing agent and this severely inhibits dye yield. Instead, diethylhydroxylamine is used because it does not inhibit dye yield.

When using low silver colour papers closely related to currently used silver chloride colour papers to be processed in a redox developer/amplifier it has been found that diethylhydroxylamine works as an effective antioxidant at first but its oxidation products cause a severe loss of hydrogen peroxide after a few hours.

Adding hydroxylamine sulphate to a developer/amplifier, as with conventional colour developers, causes dye yield to be seriously inhibited. However, the inventor has found that, unlike the case with conventional colour developers, the inhibiting effect of hydroxylamine sulphate can be overcome by increasing the level of peroxide.

Russian specification A-1075227 describes a method for producing a monochrome image by a lengthy process which includes a redox amplification step as step 9 of a 12 step process. The amplifier solution contains both resorcin and hydroxylamine and is shown to be an improvement over using resorcin alone. The solutions contain no alkaline material and it is therefore assumed that their pH values are low. The combination of resorcin and hydroxylamine is said to be essential and thus there is no disclosure that hydroxylamine alone has any utility. The present solutions have a pH of 10.5–12 and contain no resorcin.

SUMMARY OF THE INVENTION

According the the present invention there is provided an aqueous redox amplifier composition comprising a colour developing agent, hydrogen peroxide or a compound which provides hydrogen peroxide and hydroxylamine or a salt thereof wherein the concentration ranges are:

hydrogen peroxide from 0.5 to 15 ml/l (as 30% w/w solution), hydroxylamine or a salt thereof from 0.25 to 8 g/l (as hydroxylamine sulphate), and wherein the pH is in the range from 10.5 to 12.

The concentration range of the hydrogen peroxide is preferably from 0.5 to 7 ml/l and especially from 0.5 to 2 (as 30% w/w solution).

The concentration range of the hydroxylamine component is from 0.5 to 4 and especially from 0.5 to 2 g/l (as hydroxylamine sulphate).

The pH is buffered by a phosphate. The pH is preferably in the range 11 to 11.7 and especially from 11 to 11.4.

The ratio of hydrogen peroxide to hydroxylamine compound is from 1.5 to 2.5 (ml/l 30% w/w hydrogen peroxide solution:g/l hydroxylamine compound as hydroxylamine sulphate) and more preferably the ratio of hydrogen peroxide to hydroxylamine compound is from 1.75 to 2.0 (ml/l 30% w/w hydrogen peroxide solution:g/l hydroxylamine compound as hydroxylamine sulphate).

The composition is preferably free of any compound that forms a dye on reaction with oxidised colour developer.

ADVANTAGEOUS EFFECT OF THE INVENTION

The developer/amplifier solution is stabilised against loss of dye yield and as the solution ages peroxide is slowly lost. However, the effect of this loss is compensated for by the concomitant oxidation of hydroxylamine sulphate which, in turn, diminishes its inhibiting effect on peroxide. This effect was entirely unexpected as a similar effect is not observed in conventional colour developers. The stabilised developer/amplifier remains a pale straw colour without forming any deposits.

In addition hydroxylamine sulphate is more acceptable to operators who dislike the smell of diethylhydroxylamine.

DETAILED DESCRIPTION OF THE INVENTION

The hydroxylamine compound may be hydroxylamine chloride, phosphate or, preferably, sulphate. The phosphate buffer may be potassium hydrogen phosphate ($K_2HPO_4$) or other phosphates, carbonates, silicates and mixtures thereof.

The relative proportions of hydrogen peroxide (as ml/l of a 30% w/w solution) and hydroxylamine compound (as g/l hydroxylamine sulphate) need to be balanced to give the required result. It has been found that the hydrogen peroxide concentration needs to be about twice the hydroxylamine sulphate concentration.

The colour photographic material to be processed may be of any type but will preferably contain low amounts of silver halide. Preferred total silver halide coverages are in the range 6 to 300, preferably 10 to 200 mg/m$^2$ and particularly 10 to 100 mg/m$^2$ (as silver). The material may comprise the emulsions, sensitisers, couplers, supports, layers, additives, etc. described in Research Disclosure, December 1978, Item 17643, published by Kenneth Mason Publications Ltd, Dudley Annex, 12a North Street, Emsworth, Hants P010 7DQ, U.K.

In a preferred embodiment the photographic material to be processed comprises a resin-coated paper support and the emulsion layers comprise more than 80%, preferably more than 90% silver chloride and are more preferably composed of substantially pure silver chloride.

The photographic materials can be single colour materials or multicolour materials. Multicolour materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolour photographic material comprises a support bearing a yellow dye image-forming unit comprised of at least one blue-sensitive silver halide emulsion layer having associated therewith at least one yellow dye-forming coupler, and magenta and cyan dye image-forming units comprising at least one green- or red-sensitive silver halide emulsion layer having associated therewith at least one magenta or cyan dye-forming coupler respectively. The material can contain additional layers, such as filter layers.

The color developing compositions may be utilized in the various processing systems known in the art. They may be particularly useful with Low Volume Thin Tank processing systems. A Low Volume Thin Tank processor provides a small volume for holding processing solution. As a part of limiting the volume of the processing solution, a narrow processing channel is provided. The processing channel, for a processor used for photographic paper, should have a thickness equal to or less than about 50 times the thickness of paper being processed, preferably a thickness equal to or less than about 10 times the paper thickness. In a processor for processing photographic film, the thickness of the processing channel should be equal to or less than about 100 times the thickness of photosensitive film, preferably, equal to or less than about 18 times the thickness of the photographic film. An example of a low volume thin tank processor which processes paper having a thickness of about 0.080 inches would have a channel thickness of about 0.080 inches and a processor which process film having a thickness of about 0.0055 inches would have a channel thickness of about 0.10 inches.

The total volume of the processing solution within the processing channel and recirculation system is relatively smaller as compared to prior art processors. In particular, the total amount of processing solution in the entire processing system for a particular module is such that the total volume in the processing channel is at least 40 percent of the total volume of processing solution in the system. Preferably, the volume of the processing channel is at least about 50 percent of the total volume of the processing solution in the system.

In order to provide efficient flow of the processing solution through the opening or nozzles into the processing channel, it is desirable that the nozzles/opening that deliver the processing solution to the processing channel have a configuration in accordance with the following relationship:

$$1 \leqq F/A \leqq 40$$

wherein:

F is the flow rate of the solution through the nozzle in gallons per minute; and A is the cross-sectional area of the nozzle provided in square inches.

Providing a nozzle in accordance with the foregoing relationship assures appropriate discharge of the processing solution against the photosensitive material. Such Low Volume Thin Tank systems are described in more detail in

| Title | Pub. No. or Appln. No | Pub. Date |
|---|---|---|
| PROCESS RACK INTEGRAL WITH PUMPS | US 5,294,956 | 15MAR94 |
| A DRIVING MECHANISM FOR A PHOTOGRAPHIC PROCESSING APPARATUS | EP 559,027 | 08SEP93 |
| ANTI-WEB ADHERING CONTOUR SURFACE FOR A PHOTOGRAPHIC PROCESSING APPARATUS | US 5,179,404 | 12JAN93 |
| A RACK AND A TANK FOR A PHOTOGRAPHIC PROCESSING APPARATUS | EP 559,025 | 08SEP93 |
| A SLOT IMPINGEMENT FOR A PHOTOGRAPHIC PROCESSING APPARATUS | US 5,270,762 | 14DEC93 |
| RECIRCULATION, REPLENISHMENT, REFRESH, RECHARGE AND BACKFLUSH FOR A PHOTOGRAPHIC PROCESSING APPARATUS | EP 559,026 | 08SEP93 |
| PHOTOGRAPHIC PROCESSING APPARATUS | WO 92/10790 | 25JUN92 |
| PHOTOGRAPHIC PROCESSING APPARATUS | WO 92/17819 | 15OCT92 |
| PORTABLE FILM PROCESSING UNIT | WO 93/04404 | 03MAR93 |
| CLOSURE ELEMENT | WO 92/17370 | 15OCT92 |
| PHOTOGRAPHIC PROCESSING TANK | WO 91/19226 | 12DEC91 |
| METHOD AND APPARATUS FOR PHOTOGRAPHIC PROCESSING | WO 91/12567 | 22AUG91 |
| PHOTOGRAPHIC PROCESSING APPARATUS | WO 92/07302 | 30APR92 |
| PHOTOGRAPHIC PROCESSING APPARATUS | WO 93/00612 | 07JAN93 |
| PHOTOGRAPHIC PROCESSING APPARATUS | WO 92/07301 | 30APR92 |
| PHOTOGRAPHIC PROCESSING APPARATUS | WO 92/09932 | 11JUN92 |

The following Examples are included for a better understanding of the invention.

EXAMPLE 1

Comparative Example

The developer/amplifier(DA1) shown in Table 1 uses diethylhydroxylamine as the anti-oxidant at pH 10.3.

TABLE 1

| Developer/amplifier (DA1) | | |
|---|---|---|
| Sequestrant 1 | 0.6 | g/l |
| Sequestrant 2 | 2.0 | ml/l |
| $K_2CO_3$ | 25 | g/l |
| KBr | 1 | mg/l |
| KCl | 0.5 | g/l |
| Catechol disulphonate (CDS) | 0.6 | g/l |
| Diethylhydroxylamine (DEH) | 4.0 | ml/l |
| CD3 | 3.5 | g/l |
| pH | 10.3 | |

TABLE 1-continued

| Developer/amplifier (DA1) | |
|---|---|
| $H_2O_2$ (30%) | 5.0 ml/l |
| Time | 45 seconds |
| Temperature | 32° C. |

Where Sequestrant 1 is 60% solution of 1-hydroxy ethylidene-1,1-diphosphonic acid, Sequestrant 2 is a 41% solution of the penta sodium salt of diethylene triamine penta acetic acid and CD3 is N-[2-(4-amino-N-ethyl-m-toluidino)ethyl]-methanesulphonamide sesquisulphate hydrate and DEH is an 85% solution of diethylhydroxylamine.

If this solution is monitored with time while standing at operating temperature in glass measuring cylinders using standard paper control strips then the Dmax falls as shown in Table 2.

TABLE 2

| Dmax (× 100) with time (DA1) | | | |
|---|---|---|---|
| Time (hrs) | R | G | B |
| 0 | 282 | 273 | 263 |
| 1.0 | 267 | 259 | 248 |
| 2.0 | 266 | 253 | 236 |
| 3.0 | 257 | 242 | 282 |
| 5.0 | 228 | 208 | 200 |
| 6.0 | 207 | 188 | 176 |
| 24 | 071 | 097 | 098 |

EXAMPLE 2

Comparative Example

The effectiveness of hydroxylamine sulphate as an antioxidant depends on the solution pH. If the pH used in DA1 is used with potassium carbonate as the buffer then the peroxide level must be increased considerably from 4 ml/l to 14 ml/l in order to obtain full amplification. This formula (DA2) is shown in Table 3.

TABLE 3

| Developer/amplifier (DA2) | |
|---|---|
| Sequestrant 1 | 0.6 g/l |
| Sequestrant 2 | 2.0 ml/l |
| $K_2CO_3$ | 25 g/l |
| KBr | 1 mg/l |
| KCl | 0.5 g/l |
| CDS | 0.3 g/l |
| HAS | 2.0 g/l |
| CD3 | 3.5 g/l |
| pH | 10.3 |
| $H_2O_2$ (30%) | 14.0 ml/l |
| Time | 45 seconds |
| Temperature | 32° C. |

The results of a standing stability test on this formula is shown in Table 4.

TABLE 4

| Dmax (× 100) with time (DA2) | | | |
|---|---|---|---|
| Time (hrs) | R | G | B |
| 0 | 231 | 260 | 230 |
| 2 | 164 | 219 | 160 |
| 4 | 111 | 153 | 094 |
| 6 | 075 | 098 | 095 |

The standing stability of DA2 is very poor compared with that of DA4 (below) and part of this is almost certainly due to the high peroxide level needed to overcome the inhibiting effect of the hydroxylamine sulphate and obtain satisfactory amplification.

EXAMPLE 3

Comparative Example

If the composition of the developer/amplifier shown in Table 1 is changed to increase the pH the composition (DA3) shown in Table 5 below is obtained. This is changed to a new buffer, phosphate, which controls pH better at pH 11.5 and since activity at this pH is higher the peroxide level is lowered.

TABLE 5

| Developer/amplifier (DA3) | |
|---|---|
| Component | Concentration |
| Sequestrant 1 | 0.6 g/l |
| Sequestrant 2 | 2.0 ml/l |
| $K_2HPO_4.3H_2O$ | 20 g/l |
| KBr | 1 mg/l |
| KCl | 0.7 g/l |
| CDS | 0.3 g/l |
| DEH | 2.0 g/l |
| CD3 | 3.5 g/l |
| pH | 11.5 |
| $H_2O_2$ (30%) | 1.5 ml/l |
| Time | 45 seconds |
| Temperature | 32° C. |

The standing stability of this formula both with and without diethylhydroxylamine (DEH) is monitored as above. The results shown in Table 6 are obtained.

TABLE 6

| Dmax (× 100) with time (DA3) | | | | | | |
|---|---|---|---|---|---|---|
| | With DEH (2 ml/l) | | | Without DEH | | |
| Time (hrs) | R | G | B | R | G | B |
| 0 | 274 | 264 | 243 | 272 | 272 | 212 |
| 1.0 | 279 | 269 | 253 | 274 | 270 | 210 |
| 2.5 | 276 | 266 | 252 | 271 | 269 | 208 |
| 4.15 | 279 | 267 | 250 | 273 | 272 | 207 |
| 5.0 | 281 | 269 | 263 | 272 | 270 | 205 |
| 6.0 | 267 | 259 | 255 | 272 | 270 | 202 |
| 24 | 073 | 097 | 102 | 269 | 267 | 201 |

It can be seen from Table 6 that up to 6 hours the stability of DA3 with DEH is much better than DA1. After 24 hours both DA1 and DA3 with DEH have essentially become inactive, the densities indicating no amplification. If the DEH is left out of DA3 then the stability is much better with almost full amplification still present after 24 hours. Peroxide analysis with time shows that for DA3 with DEH it falls by about 15% in 6 hours but much more rapidly later. At 24 hours there is no peroxide left. If after 24 hours more peroxide is added then the loss rate is still much higher than a fresh solution. In DA3 without DEH, peroxide loss is about the same over the entire 24 hours. This indicates that although the stability with DEH is quite good for a few hours some product from or caused by DEH accelerates peroxide loss at longer times. This does not happen without DEH. In the absence of an anti-oxidant however the Dmin density is higher because there is no scavenging of oxidised developer in the bulk of the solution and this couples to give an unacceptable Dmin increase. This means that an anti-oxidant is necessary for Dmin control but tends to accelerate peroxide loss.

EXAMPLE 4

Invention

If the anti-oxidant DEH in DA3 is replaced by hydroxylamine sulphate (HAS) then very little amplification is observed in the fresh developer/amplifier. This effect is thought to be similar to the effect of hydroxylamine in conventional developers for colour paper based on silver chloride emulsions. Here hydroxylamine acts as a black and white developer and severely reduces the extent of dye formation for a given silver laydown. It has now been found that if the normal level of hydrogen peroxide used in DA3 is increased when hydroxylamine is used as the anti-oxidant then amplification occurs and the fresh sensitometry is restored. This new formula is shown in Table 7.

TABLE 7

| Developer/amplifier (DA4) | |
|---|---|
| Component | Concentration |
| Sequestrant 1 | 0.6 g/l |
| Sequestrant 2 | 2.0 ml/l |
| $K_2HPO_4.3H_2O$ | 40 g/l |
| KBr | 1 mg/l |
| KCl | 0.5 g/l |
| CDS | 0.3 g/l |
| HAS | 2.0 g/l |
| CD3 | 3.5 g/l |
| pH | 11.5 |
| $H_2O_2$ (30%) | 4.0 ml/l |
| Time | 45 seconds |
| Temperature | 32° C. |

The results of the standing stability test as used above is shown in Table 8.

TABLE 8

| Dmax (× 100) with time (DA4) | | | |
|---|---|---|---|
| Time (hrs) | R | G | B |
| 0 | 233 | 267 | 253 |
| 2 | 234 | 265 | 248 |
| 4 | 241 | 269 | 251 |
| 6 | 232 | 263 | 244 |
| 24 | 238 | 262 | 230 |

It can be seen from the results that most of the activity present in the fresh developer/amplifier is still present after 24 hours whereas both DA1 and DA2 with DEH show no amplification at all after 24 hours.

EXAMPLE 5

Invention

The level of hydroxylamine is important because the more there is the greater the inhibition of amplification. Several developer/amplifiers based on DA4 were made up with different hydroxylamine levels. In order to obtain correct sensitometry the peroxide level needs to be changed with hydroxylamine level as shown in Table 9 below. The standing stability test was carried out on these formulae and the Dmax at the start and after 6 hours and 24 hours is shown in Table 9 below.

TABLE 9

| Developer/amplifiers with different HAS levels | | | | | | | | | | |
|---|---|---|---|---|---|---|---|---|---|---|
| HAS | $H_2O_2$ | Dmax (×100) Start | | | Dmax (×100) 6 hrs | | | Dmax (×100) 24 hrs | | |
| (g/l) | (ml/l) | R | G | B | R | G | B | R | G | B |
| 0 | 0.5 | 245 | 255 | 234 | 199 | 216 | 201 | 075 | 097 | 101 |
| 1.0 | 2.0 | 252 | 259 | 248 | 256 | 263 | 244 | 261 | 266 | 246 |
| 2.0 | 4.0 | 261 | 266 | 250 | 263 | 269 | 254 | 257 | 262 | 230 |
| 3.0 | 5.7 | 254 | 264 | 250 | 265 | 264 | 243 | 249 | 265 | 227 |
| 4.0 | 7.0 | 255 | 266 | 254 | 252 | 266 | 247 | 240 | 266 | 223 |

It can be seen that the level of peroxide needs to be increased with HAS level in order to maintain sensitometry and that the peroxide/HAS ratio is roughly constant at 2.0 (as a ratio of ml/l of a 30% w/w solution of $H_2O_2$ to g/l hydroxylamine as hydroxylamine sulphate). This means that about the same sensitometry can be obtained with different HAS levels provided the peroxide level is changed to match. As well as this less peroxide is needed at lower HAS levels and this shows up in the better standing stability with the lower HAS and peroxide levels. At zero HAS however with the least peroxide the stability is the worst of all. This is different from the result with zero anti-oxidant in Table 6 because the level of peroxide in Table 6 is too high for good sensitometry. This excess peroxide does not cause much of an increase in fresh sensitometry because for the red and green layers at least the reflection density is already at the reflection limit. This means that any loss in peroxide does not show up as a loss in density and so the system appears to be sensitometrically stable. The blue layer tends to be lower in activity at high peroxide levels and this is reflected in the low Dmax values for the data in Table 6. When peroxide loss occurs the competition from the red and green layers decreases and the blue layer benefits. This means that the blue layer does not fall in density as much as it would if the initial peroxide was lower as it was for the data in Table 9.

EXAMPLE 6

Invention

In FIG. 1 the data for the chemical analysis of DA4 as it ages in the standing stability test is shown. It can be seen that the CD3, hydrogen peroxide and hydroxylamine all slowly lose concentration. It is known that the the loss of peroxide and CD3 lowers activity but the loss of HAS increases activity. The net result of this compensation is that sensitometry falls at a lower rate than for a similar case in the absence of HAS. This with the absence of accelerated peroxide loss with HAS as compared with diethylhydroxylamine as the antioxidant represent the two reasons why HAS allows much more stable redox developer/amplifiers.

EXAMPLE 7

Processing was carried out as before but in a low volume thin tank, as described in copending European Application 0 515 454 or 0 532 558 having a space between parallel major walls of 3 mm, over a period of 69 hours. The developer/amplifier had the following formulation:

| Component | Concentration |
|---|---|
| Sequestrant 1 | 0.6 g/l |
| Sequestrant 2 | 2.0 ml/l |
| $K_2HPO_4.3H_2O$ | 40 g/l |
| KBr | 1 mg/l |
| KCl | 0.5 g/l |
| CDS | 0.3 g/l |
| HAS | 1.0 g/l |
| KOH (30%) | 1.0 ml/l |
| CD3 | 4.5 g/l |
| pH | 11.5 |
| $H_2O_2$ (30%) | 2.0 ml/l |
| Time | 45 seconds |
| Temperature | 35° C. |

Dmax for the red, green and blue images are recorded below in Table 10. The comparable figures for developer/amplifier DEVELOPER/AMPLIFIER 1 of Example 1 are also shown.

TABLE 10

| | Dmax (× 100) with time | | |
|---|---|---|---|
| | R | G | B |
| Time (hrs) | | | |
| 0 | 244 | 256 | 246 |
| 2 | 238 | 257 | 241 |
| 4.5 | 240 | 255 | 239 |
| 21.3 | 241 | 251 | 230 |
| 28.3 | 248 | 255 | 228 |
| 44.5 | 252 | 253 | 226 |
| 69.0 | 261 | 257 | 220 |
| Dev/Amp DA1 | | | |
| 0.5 | 254 | 248 | 222 |
| 1.1 | 251 | 245 | 227 |
| 3.2 | 235 | 228 | 190 |
| 5.5 | 209 | 204 | 169 |

It can be seen that the comparative developer/amplifier shows a falling off of the Dmax values at 5.5 hours whereas the developer/amplifier of the invention shows very little effect over 69 hours.

EXAMPLE 8

A further processing run was carried as before but in a conventional minilab apparatus. The developer/amplifier had the following composition:

| Component | Concentration |
|---|---|
| Sequestrant 1 | 0.6 g/l |
| Sequestrant 2 | 2.0 ml/l |
| $K_2HPO_4.3H_2O$ | 40 g/l |
| KBr | 1 mg/l |
| KCl | 0.5 g/l |
| CDS | 0.3 g/l |
| HAS | 1.0 g/l |
| KOH (50%) | 10.0 ml/l |
| CD3 | 4.5 g/l |
| pH | 11.4 |
| $H_2O_2$ (30%) | 2.0 ml/l |
| Time | 45 seconds |
| Temperature | 32° C. |

The results are shown in Table 11 below.

TABLE 11

| | Dmax (× 100) with time | | |
|---|---|---|---|
| Time (hrs) | R | G | B |
| 0 | 266 | 265 | 263 |
| 24 | 264 | 263 | 255 |
| 48 | 267 | 264 | 249 |
| 72 | 276 | 268 | 254 |
| 96 | 278 | 272 | 227 |
| 192 | 223 | 232 | 214 |
| 216 | 121 | 138 | 149 |

The results that consistent sensitometric results were obtained over a period of 96 hours while serious deterioration only occurred at 216 hours.

The invention has been described in detail with particular reference to preferred embodiments thereof, but it will be understood the variations and modifications can be effected within the spirit and scope of the invention.

What is claimed is:

1. An aqueous redox amplifier composition comprising a colour developing agent, hydrogen peroxide or a compound which provides hydrogen peroxide and hydroxylamine or a salt thereof wherein the concentration ranges are hydrogen peroxide from 0.5 to 10 ml/l (as 30% w/w solution), hydroxylamine or a salt thereof from 0.25 to 4 g/l (as hydroxylamine sulphate), and wherein the pH range is in the range of from 11 to 12, and the ratio of hydrogen peroxide to hydroxylamine compound is from 1.5 to 2.5 (ml/l 30% w/w hydrogen peroxide solution:g/l hydroxylamine compound as hydroxylamine sulphate).

2. A composition as claimed in claim 1 in which the concentration range of the hydrogen peroxide is from 0.5 to 7 ml/l (as 30% w/w solution).

3. A composition as claimed in claim 1 in which the concentration range of the hydrogen peroxide is from 0.5 to 2 ml/l (as 30% w/w solution).

4. A composition as claimed in claim 1 in which the concentration range of the hydroxylamine component is from 0.5 to 4 g/l (as hydroxylamine sulphate).

5. A composition as claimed in claim 1 in which the concentration range of the hydroxylamine component is from 0.5 to 2 g/l (as hydroxylamine sulphate).

6. A composition as claimed in claim 1 in which the ratio of hydrogen peroxide to hydroxylamine compound is from 1.75 to 2.0 (ml/l 30% w/w hydrogen peroxide solution:g/l hydroxylamine compound as hydroxylamine sulphate).

7. A composition as claimed in claim 1 in which the pH is buffered by a phosphate.

8. A composition as claimed in claim 1 in which the pH is from 11 to 11.7.

9. A composition as claimed in claim 8 in which the pH is from 11 to 11.4.

10. A method for processing an imagewise exposed colour photographic element comprising contacting said element with an aqueous redox amplifier composition comprising colour developing agent, hydrogen peroxide or a compound which provides hydrogen peroxide and hydroxylamine or a salt thereof wherein the concentration ranges are hydrogen peroxide from 0.5 to 10 ml/l (as 30% w/w solution), hydroxylamine or a salt thereof from 0.25 to 4 g/l (as hydroxylamine sulphate), and wherein the pH range is in the range of from 11 to 12 and the ratio of hydrogen peroxide to hydroxylamine compound is from 1.5 to 2.5 (ml/l 30% w/w hydrogen peroxide solution:g/l hydroxylamine compound as hydroxylamine sulphate).

11. The method of claim 10 wherein said element comprises from 6 to 300 $mg/m^2$ of silver halide.

12. The method of claim 10 wherein said element is a photographic paper having a resin-coated paper support and at least one emulsion layer having more than 80% silver chloride.

13. The method of claim 10 wherein said processing is carried out in a low volume thin tank processing system.

14. A method for processing an imagewise exposed color photographic paper having at least one emulsion layer having more than 80% silver chloride, comprising contacting said paper with the composition of claim 6.

15. The method of claim 14 wherein said paper has at least one emulsion having more than 90% silver chloride.

* * * * *